US007457551B2

(12) United States Patent
Shishikura

(10) Patent No.: US 7,457,551 B2
(45) **Date of Patent: *Nov. 25, 2008**

(54) FIXING APPARATUS

(75) Inventor: Kenichiro Shishikura, Numazu (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/882,337

(22) Filed: Aug. 1, 2007

(65) Prior Publication Data

US 2008/0019716 A1 Jan. 24, 2008

Related U.S. Application Data

(63) Continuation of application No. 10/300,744, filed on Nov. 21, 2002, now Pat. No. 7,260,333.

(51) Int. Cl.
*G03G 15/00* (2006.01)

(52) U.S. Cl. ..... 399/44; 399/70

(58) Field of Classification Search ..... 399/70, 399/44

See application file for complete search history.

(56) References Cited

U.S. PATENT DOCUMENTS

| | | | |
|---|---|---|---|
| 5,138,379 | A | 8/1992 | Kanazashi |
| 5,515,152 | A | 5/1996 | Kuo |
| 5,771,421 | A | 6/1998 | Kim |
| 6,768,882 | B2 | 7/2004 | Omoto et al. |
| 7,177,560 | B2 | 2/2007 | Fujisawa |

FOREIGN PATENT DOCUMENTS

| | | | |
|---|---|---|---|
| JP | 5-35148 | A | 2/1993 |

*Primary Examiner*—David M Gray
*Assistant Examiner*—Bryan Ready
(74) *Attorney, Agent, or Firm*—Foley & Lardner LLP

(57) ABSTRACT

A fixing unit adapted to fix a developing agent onto an image forming medium by way of a heat roller containing a heater and a press roller conducts a warming up operation for the optimum warming up time as determined based on the temperature and the humidity of ambient air detected by a temperature/humidity sensor.

18 Claims, 5 Drawing Sheets

| Temperature (℃) | 10 | | | 23 | | | 30 | | |
|---|---|---|---|---|---|---|---|---|---|
| Humidity (%) | 20 | 50 | 85 | 20 | 50 | 85 | 20 | 50 | 85 |
| Curl quantity (mm) | 5 | 8 | 18 | 8 | 10 | 38 | 15 | 30 | 46 |

| Temperature (℃) | 10 | | | 23 | | | 30 | | |
|---|---|---|---|---|---|---|---|---|---|
| Humidity (%) | 20 | 50 | 85 | 20 | 50 | 85 | 20 | 50 | 85 |
| Warming up time (sec) | 189 | 190 | 187 | 148 | 150 | 148 | 119 | 119 | 117 |
| Temperature difference (℃) | 71 | 69 | 71 | 102 | 100 | 103 | 117 | 116 | 118 |

| Temperature difference (℃) | 20 | 30 | 50 | 70 | 100 | 120 | 140 |
|---|---|---|---|---|---|---|---|
| Curl quantity (mm) | 3 | 5 | 12 | 21 | 33 | 42 | 53 |

FIG. 6

| Warming up time (sec) | 100 | 120 | 150 | 170 | 180 | 190 |
|---|---|---|---|---|---|---|
| Curl quantity (mm) | 51 | 45 | 28 | 19 | 13 | 8 |
| Temperature difference (℃) | 135 | 119 | 89 | 68 | 53 | 40 |
| Fixing ratio (%) | 72 | 82 | 88 | 92 | 95 | 96 |

FIG. 7

| Temperature (℃) | 10 | | | 23 | | | 30 | | |
|---|---|---|---|---|---|---|---|---|---|
| Humidity (%) | 20 | 50 | 85 | 20 | 50 | 85 | 20 | 50 | 85 |
| Warming up time (sec) | 190 | 190 | 200 | 150 | 150 | 170 | 120 | 140 | 180 |
| Curl quantity (mm) | 5 | 8 | 13 | 8 | 10 | 13 | 12 | 13 | 13 |

FIG. 8

FIXING APPARATUS

BACKGROUND OF THE INVENTION

The present application is a continuation of U.S. application Ser. No. 10/300,744, filed Nov. 21, 2002, the entire contents of which is incorporated herein by reference.

This invention relates to a fixing apparatus that can typically be used in an image forming apparatus for the purpose of fixing a developing agent such as toner to the image forming medium.

Conventionally, a fixing apparatus for fixing the toner on an image forming medium is driven for warming up (a pre-run) prior to the fixing operation, in order to secure the ratio of fixing toner on the image forming medium to a required level. For warming up, the heater is turned on and the heat roller is driven to rotate. As a result, the heat roller and the press roller that is held in contact with the heat roller are warmed. The fixing ratio of fixing the developing agent to the image forming medium is secured to a required level by such a warming up operation.

The major objective of such a warming up operation is to secure the fixing ratio to a required level. The warming up time of the warming up operation that is performed for the entire apparatus is reduced as much as possible in fixing apparatuses that have been marketed in recent years. However, as the warming up time is reduced, the risk of producing a large curl on the sheet of paper coming out of the fixing apparatus rises. It is believed that the sheet of paper is curled by the fixing apparatus because the developing agent is fixed to the sheet of paper by applying both pressure and heat by means of the heat roller and the press roller.

As the extent of curl of the sheet of paper increases, so does the likelihood of it being jammed in the conveyance path after the fixing process, thus it may not be properly delivered onto the delivery tray. Other problems may also arise. Therefore, some conventional fixing apparatuses are provided with a mechanism specifically designed to physically reduce the risk of curling sheets of paper, and is arranged on the conveyance path of sheets of paper coming out of the fixing apparatus.

BRIEF SUMMARY OF THE INVENTION

The present invention has been mode in view of the foregoing. An object of the invention is to provide a fixing apparatus that can secure the fixing ratio to a predetermined level, and at the same time, reduce the extent of curl of the image forming medium.

According to an aspect of the invention, the above object is achieved by providing a fixing apparatus for fixing the developing agent to an image forming medium, the apparatus comprising: a heat roller containing a heater; a press roller held in contact with the heat roller under predetermined pressure and heated by heat coming from the heat roller; a humidity sensor which detects the humidity of ambient air; a memory storing data on the warming up time to be observed for the warming up operation of the heat roller and the press roller in order to correspond to the humidity of ambient air; and a control section which determines the warming up time corresponding to the humidity detected by the humidity sensor based on the data stored in the memory and conducts a warming up operation of the heat roller and the press roller.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate an embodiment of the invention, and together with the general description given above and the detailed description of the embodiment given below, serve to explain the principles of the invention.

FIG. 6 is a chart of the values observed for the curl quantity with various temperature differences between the heat roller and the press roller;

FIG. 7 is a chart of the values observed for the curl quantity of each number of sheets of paper, the temperature difference between the heat roller and the press roller and the fixing ratio for various warming up times;

FIG. 8 is a chart of the warming up times specified for various combinations of temperature and humidity and the values observed for the curl quantity of each of a number of sheets of paper observed for the specified warming up times;

DETAILED DESCRIPTION OF THE INVENTION

The embodiment of the invention will be described with reference to the accompanying drawings.

Figure 1:
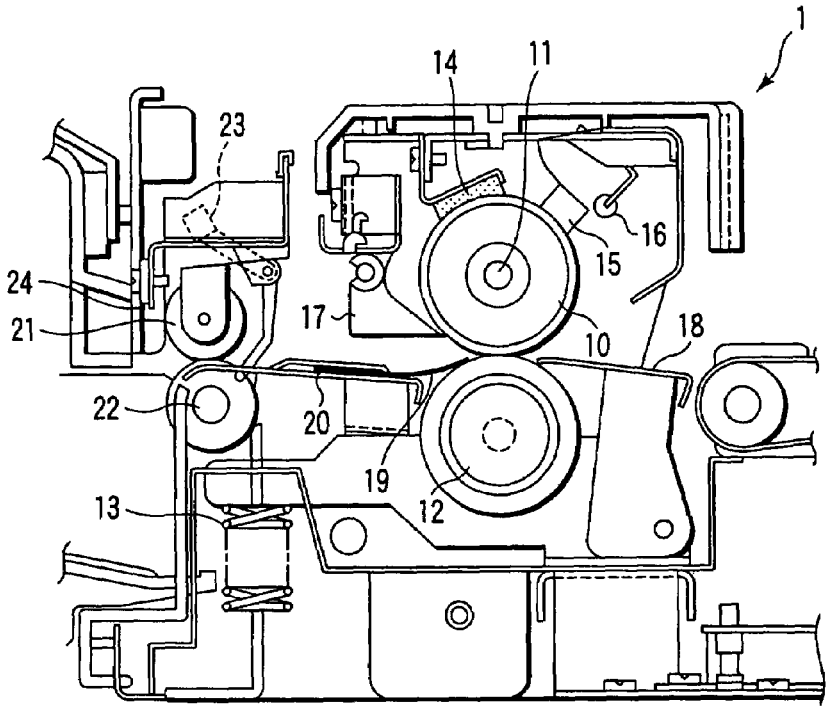
FIG. 1 is a schematic view showing the configuration of a fixing apparatus.

FIG. 1 is a schematic view showing the configuration of a fixing unit (fixing apparatus) applied to an image forming apparatus described in Jpn. Pat. Appln. KOKAI Publication No. 5-35148. As shown in FIG. 1, the fixing unit 1 comprises a heat roller 10, a heater 11, a press roller 12, a pressure spring 13, a cleaning felt 14, a thermistor 15, a temperature fuse 16, a peeling claw 17, a paper guide 18, a scraper 19, another paper guide 20, a delivery roller 21, another delivery roller 22, a delivery switch 23 and a charge eliminating brush 24.

The heat roller 10 contains the heater 11. The heater 11 may typically be formed by using a heating lamp or an IH heater. The press roller 12 is pressed against and held in contact with the heat roller 10 by the pressure spring 13. The heat roller 10 is driven to rotate by a main motor 46, which will be described later. The press roller 12 follows the rotary motion of the heat roller 10.

The cleaning felt 14 is adapted to clean the surface of the heat roller 10. The thermistor 15 detects the surface temperature of the heat roller 10. The temperature fuse 16 forcibly breaks the power supply to the heater 11 when the temperature in the fixing unit 1 is abnormally high. The peeling claw 17 peels the sheet of paper passing between the heat roller 10 and the press roller 12 from the heat roller 10.

The paper guide 18, the scraper 19 and the paper guide 20 guide and convey a sheet of paper in the fixing unit 1. The delivery rollers 21, 22 deliver the sheet of paper after passing the fixing unit 1 to the outside of the fixing unit 1. The delivery switch 23 detects the sheet of paper being delivered to the outside. The charge eliminating brush 24 is a brush for eliminating the electric charge of a sheet of paper.

Now, the overall schematic configuration of the image forming apparatus comprising the above described fixing unit 1 will be described.

Figure 2:
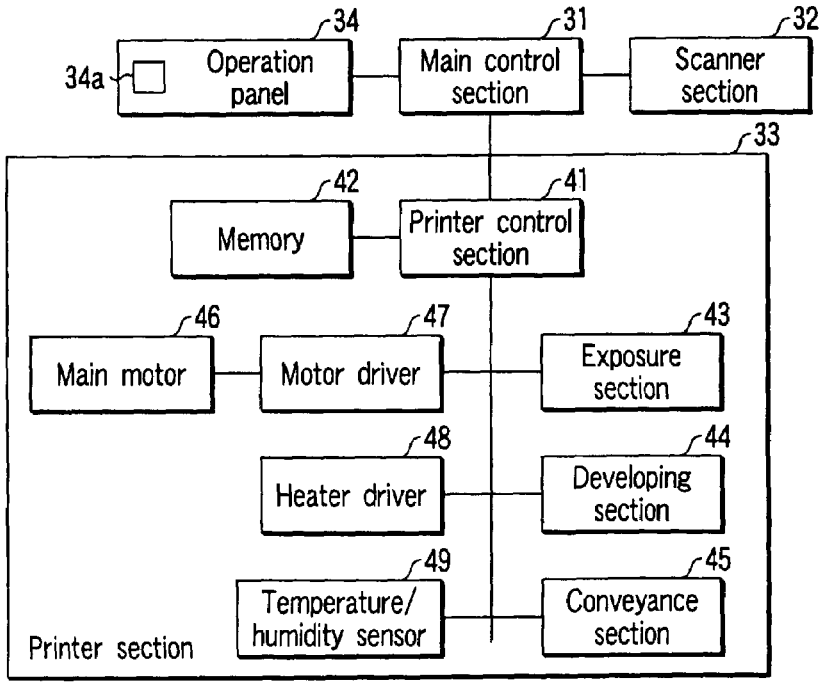
FIG. 2 is a schematic block diagram showing the control system of a fixing apparatus.

FIG. 2 is a schematic block diagram of the image forming apparatus, illustrating its overall configuration. As shown in FIG. 2, the image forming apparatus comprises a main control section 31, a scanner section 32, a printer section 33 and an operation panel 34. The main control section 31 controls the entire image forming apparatus. The scanner section 32 optically reads the original to obtain an image thereof. The printer section 33 prints the obtained image on a sheet of paper. The operation panel 34 provides the user with guidance for operation and has various operation keys by way of which the user can input operation commands.

The printer section 33 comprises a printer control section 41, a memory 42, an exposure section 43, a developing section 44, a conveyance section 45, a main motor 46, a motor driver 47, a heater driver 48 and a temperature/humidity sensor 49. The printer control section 41 controls the entire printer section. The memory 42 stores various control programs and control data.

The exposure section 43 forms an electrostatic latent image on a photosensitive drum (not shown) by causing the photosensitive drum to sense light according to the image information applied to it. The developing section 44 forms a toner image (developing agent image) to a sheet of paper (image forming medium) based on the electrostatic latent image formed on the photosensitive drum. The conveyance section 45 controls the conveyance of the sheet of paper in the printer.

The main motor 46 drives various rollers in the printer section 33 to rotate. The main motor 46 is controlled by the motor driver 47 for its driving operation. The heater driver 48 controls the operation of turning on/off the heater 11. The temperature/humidity sensor 49 is arranged in the fixing unit 1 or in the image forming apparatus. The temperature/humidity sensor 49 is arranged at a position where it can accurately detect the temperature and the humidity of ambient air and is not significantly influenced by any temperature rise in the image forming apparatus.

Now, the basic operation of the fixing unit 1 will be described.

The fixing unit 1 fixes the developing agent on a sheet of paper to the sheet.

Firstly, before starting a fixing operation, the fixing unit 1 conducts a warming up (pre-run) operation. Warming-up is an operation for raising the surface temperature of the heat roller 10 and that of the press roller 12 to a temperature level that allows a fixing operation to be performed successfully. More specifically, for a warming up operation, the heater driver 48 turns on the heater 11 and the main motor 46 drives the heater roller 10 and the press roller 12 to rotate.

For example, as the warming up operation is over in the fixing unit 1 of an image forming apparatus, the toner image is transferred from the photosensitive drum (not shown) onto a sheet of paper. The sheet of paper onto which the toner image has been transferred is then conveyed to between the heat roller 10 and the press roller 12 by the paper guide 18. As the sheet of paper passes between the heat roller 10 and the press roller 12, it is heated and pressurized. As a result, the toner image on the sheet of paper is fixed to the sheet.

After passing between the heat roller 10 and the press roller 12, the sheet of paper is peeled off from the heat roller 10 by the peeling claw 17. The sheet of paper that has been peeled off from the heat roller 10 is then conveyed to the delivery rollers 21, 22 by the scraper 19 and the paper guide 20. The sheet of paper is detected by the delivery switch 23 immediately before getting to the delivery rollers 21, 22. The sheet of paper detected by the delivery switch 23 is then further conveyed to the outside of the fixing unit 1 by the delivery rollers 21, 22. As the sheet of paper is conveyed to the outside of the fixing unit 1 by the delivery rollers 21, 22, its electric charge is eliminated by the charge eliminating brush 24.

Now, the curl that can take place to the sheet of paper will be described.

Figures 3, 4, 5:
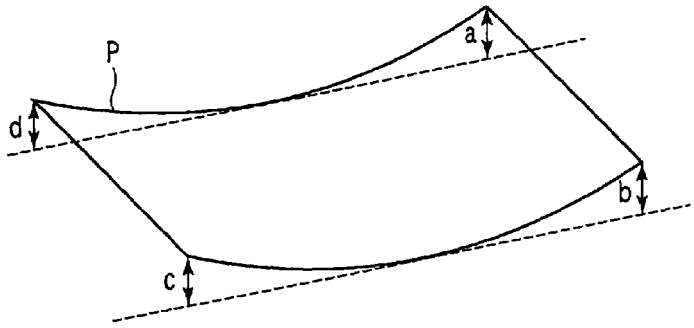
FIG. 3 is an illustration showing a sheet of paper for defining the curl quantity.
FIG. 4 is a chart of the values observed for the curl quantity with various temperatures and humidities.
FIG. 5 is a chart of the values observed for the temperature difference between the heat roller and the press roller for various temperatures, humidities and warming up times.

Normally, the fixing unit 1 is so controlled that the curl quantity of the sheet of paper that has been subjected to a fixing operation is less than a predetermined level. For example, the curl quantity is determined from the average value of the distances between the four corners of the sheet of paper that is held in contact with a horizontal plane and the horizontal plane as shown in FIG. 3. In the instance of FIG. 3, the curl quantity is the average of a, b, c and d. Such a curl of a sheet of a paper can give rise to a problem during of conveyance, such as a jam. Therefore, the image forming apparatus is so designed to suppress the curl quantity of the sheet of paper to less than a predetermined level.

FIGS. 4 through 6 are charts of the values observed for the curl quantity of each of a number of sheets of paper after passing the fixing unit 1.

FIG. 4 is a chart of the values observed for the curl quantity of each of a number of sheets of paper in various operation environments when a warming up operation is conducted until the surface of the heat roller 10 gets to a predetermined temperature (fixing temperature that provides a predetermined satisfactory fixing ratio). In the instance of FIG. 4, the operation environment refers to the temperature and the humidity in the fixing unit 1 and the curl quantity of each of a number of sheets of paper was observed at different temperatures (10° C. (low temperature), 23° C. (normal temperature), 30° C. (high temperature)) and at different humidities (20% (low humidity), 50% (normal humidity), 85% (high humidity)).

As a result of experiments, it is known that a jam can take place when the curl quantity exceeds 30 mm. Therefore, it will be seen that the curl quantity exceeds 30 mm and a jam takes place at normal temperature and high humidity, at high temperature and normal humidity and at high temperature and high humidity.

FIG. 5 is a chart of the values observed for the temperature difference between the heat roller 10 and the press roller 12 and the time for the surface of the heat roller 10 to get to a predetermined temperature (temperature that provides a satisfactory fixing ratio) in the operation environments same as those of FIG. 4. The result of observation in FIG. 5 shows the relation of the time for the surface of the heat roller 10 to get to a predetermined temperature and the temperature difference between the heat roller 10 and the press roller 12.

From FIG. 5, it will be seen that the time spent for the surface of the heat roller 10 to get to a predetermined temperature is short in a high temperature environment. To be more accurate, the time to get to a temperature that provides a satisfactory fixing ratio is short in a high temperature environment. It will also be seen from FIG. 5 that the temperature difference between the heat roller 10 and the press roller 12 is large when the warming up time is short.

Thus, from the results of observation summarized in FIGS. 4 and 5, it is seen that the curl quantity is large in a humid environment. It is also seen that the curl quantity is large when the temperature difference between the heat roller 10 and the press roller 12 is large.

FIG. 6 is a chart of the values observed for the curl quantity with various temperature differences between the heat roller 10 and the press roller 12 in an operation environment of high temperature and high humidity (30° C., 85%).

The results of observation summarized in FIG. 6 reflect the influence of the temperature difference between the heat roller 10 and the press roller 12 on the curl quantity of each of a number of sheets of paper. As seen from FIG. 6, the curl quantity increases as the temperature difference increases. It is also seen from FIG. 6 that the curl quantity exceeds 30 mm when the temperature difference exceeds 100° C. Therefore, the curl quantity of a sheet of paper can be reduced by reducing the temperature difference between the heat roller and the press roller.

From the above described results of observation, it is seen that the humidity and the temperature difference between the heat roller and the press roller are factors that can give rise to a large curl quantity. The temperature difference between the heat roller and the press roller is influenced by ambient temperature that is a factor of the operation environment of the fixing unit.

At normal humidity, the moisture content of the sheet of paper is low. Therefore, the sheet of paper does not show a large curl quantity. To the contrary, the moisture content of the sheet of paper is high particularly in a humid environment. Then, the sheet of paper that has been subjected to a fixing operation in the fixing unit can curl to a large extent.

Meanwhile, the time spent for a warming up operation of the fixing unit has been reduced in recent years. However, the curl quantity of the sheet of paper can be very large if the warming up time is selected so as to only secure the lowest limit of the fixing ratio without considering the temperature difference between the heat roller and the press roller for the purpose of minimizing the warming up time.

In other words, if the warning up time is so selected as to only secure the lowest limit of the fixing ratio, the temperature difference between the heat roller and the press roller can be very large because heat is not conveyed sufficiently from the heat roller to the press roller in such a short warming up time. Then, the curl quantity of the sheet of paper can become very large due to the temperature difference between the heat roller and the press roller. Particularly, in the case of a fixing unit that has not been operated for a long period of time, the press roller will not be warmed sufficiently immediately after turning on the power switch. Then, the curl quantity of the sheet of paper will be very large.

Therefore, it is possible to provide a fixing unit that does not require an unnecessarily long warming up time and at the same time can secure a predetermined fixing ratio and reduce the curl quantity by selecting an optimum warming up time that corresponds to the temperature and the humidity in the operation environment.

While the values listed in FIGS. 4 and 5 were obtained as a result of a number of experiments conducted in typical operation environments, the warming up time may be selected based on the data obtained in more minutely differentiated operation environments. In other words, a more optimum warming up time can be selected based on the data that can be obtained in more minutely differentiated operation environments.

Now, how the warming up time is selected will be described.

FIG. 7 is a chart of the values observed for the curl quantity of each of a number of sheets of paper, the temperature difference between the heat roller and the press roller and the fixing ratio for various warming up times in an operation environment of high temperature and high humidity (30° C., 85%).

As shown in FIG. 7, the curl quantity of the sheet of paper is reduced and the fixing ratio is improved when a long warming up time is selected. The allowable lower limit of fixing ratio is defined to be 80% and the allowable upper limit of curl quantity is defined to be 15 mm. Then, the warming up time needs to be 120 sec or more when only the fixing ratio is taken into consideration. However, it needs to be 180 sec or more when the curl quantity is taken into consideration. Therefore, from the results of observation listed in FIG. 7, the optimum warming up time of high temperature and high humidity (30° C., 85%) is judged to be 180 sec.

FIG. 8 is a chart of the warming up times specified for various combinations of temperature and humidity and the values observed for the curl quantity.

As shown in FIG. 8, the curl quantity is suppressed to less than 15 mm in any operation environment when the warming up time is defined by taking both temperature and humidity into consideration. By comparing the results of observation listed in FIG. 4 and those listed in FIG. 8, it will be seen that the curl quantity was reduced to 15 mm in FIG. 8 in all operation environments (10° C. and 85%, 23° C. and 85%, 30° C. and 20%, 30° C. and 50%, 30° C. and 85%) of FIG. 4 where the curl quantity exceeded 15 mm.

Now, the operation of a fixing apparatus according to the invention will be described when the warming up time is defined as a function of the temperature and the humidity in the operation environment.

Figure 9:
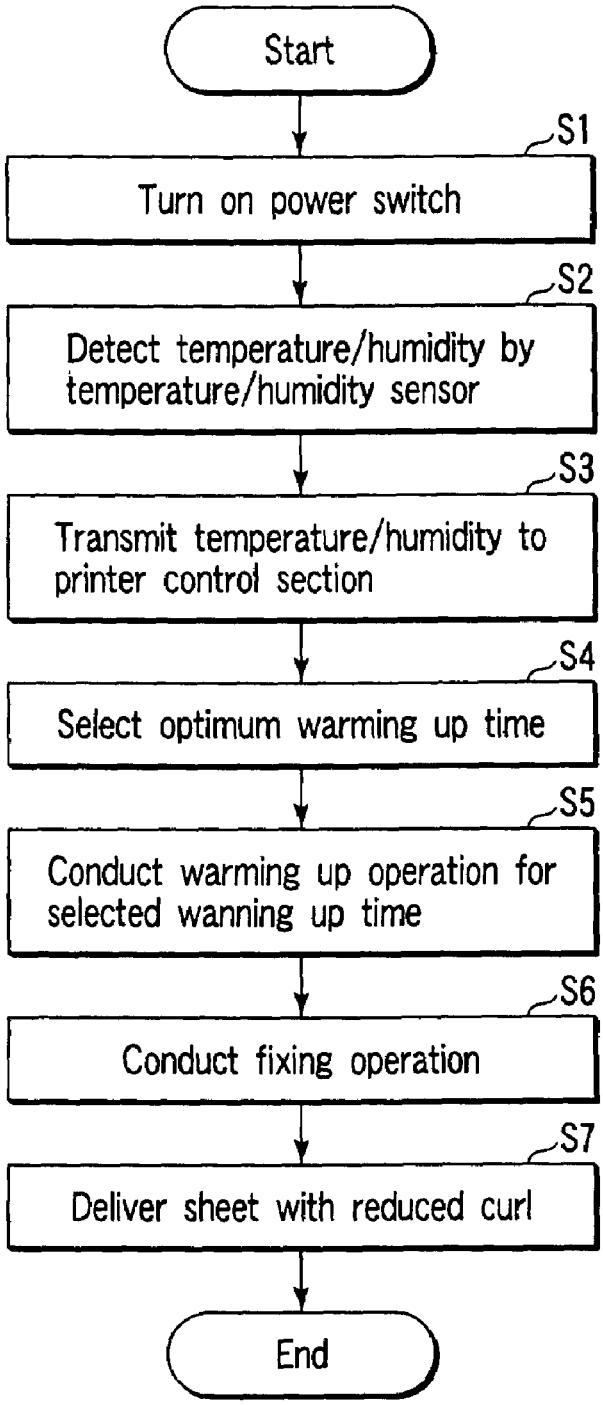
FIG. 9 is a flowchart of the warming up operation with the warming up time specified for the detected temperature and humidity.

FIG. 9 is a flow chart of the warming up operation with the warming up time specified for the temperature and humidity.

Assume that the warming up times for different operation environments as shown in FIG. 8 are stored in the memory 42 in advance.

For example, as the power switch of the image forming apparatus is turned on, the printer control section 41 determines the start of a warming up operation of the fixing unit. More specifically, as the power switch of the fixing unit 1 is turned on (Step S1), the printer control section 41 first detects the temperature and the humidity of ambient air by means of the temperature/humidity sensor 49 (Step S2). The temperature/humidity sensor 49 provides the printer control section 41 with a signal representing the temperature and the humidity it detected (Step S3).

Upon receiving the signal representing the temperature and the humidity from the temperature/humidity sensor 49, the printer control section 41 determines the warming up time that corresponds to the temperature and the humidity in the operation environment in the signal received from the temperature/humidity sensor 49 based on the data stored in the memory 42 (Step S4). As the printer control section 41 determines the warming up time that corresponds to the temperature and the humidity, it starts an warming up operation using the warming up time it has determined (Step S5).

As the warming up operation is over, the printer control section 41 starts the fixing operation to fix the toner onto the sheet of paper (Step S6). As a result of the fixing operation, the fixing unit 1 delivers the sheet of paper with reduced curl quantity (Step S7).

As described above, optimum warming up times are defined in advance for different combinations of temperature and humidity in the operation environment and a temperature/humidity sensor is arranged in the fixing unit. When the fixing unit is actually driven to operate, the optimum warming up time is selected for the temperature and the humidity detected by the temperature/humidity sensor and a warming up operation is conducted for the selected optimum warming up time.

With this arrangement, it is now possible to conduct a warming up operation for an optimum warming up time (the shortest warming up time) that can secure a predetermined fixing ratio and at the same time suppress the curl quantity to less than a predetermined level. Since the warming up operation can be conducted for the optimum warming up time according to the operation environment, the warming up operation is unnecessarily prolonged. Thus, the problem of wasting consumables in the fixing unit can be solved.

Now, a modified operation of the above described embodiment will be described below.

With this modified operation, in addition to the above described embodiment, the user can issue a command for further reducing the curl quantity. As will be described below, the optimum warming up time defined in advance for the temperature and the humidity of the current operation environment can be extended according to the input of the curl reduction key 34*a* arranged on the operation panel 34.

It is assumed here that the warming up time is extended by a predetermined time period each time the curl reduction key 34*a* is depressed to input a signal. More specifically, the warming up time is extended by a predetermined time period (e. g., 5 seconds) when the curl reduction key 34*a* is depressed once and it is extended by twice of the predetermined time period (e.g., 5×2=10 seconds) when the curl reduction key 34 is depressed twice.

Alternatively, it may be so arranged that the warming up time is extended for the time period during which the curl reduction key 34*a* is depressed. Further, it may be so arranged that the degree of reducing the curl quantity is specified by using the ten keys. Further still, it may be so arranged that the degree of reducing the curl quantity is specified by using a roll up key or a roll down key as in the case of issuing a command for specifying the image density.

Figure 10:
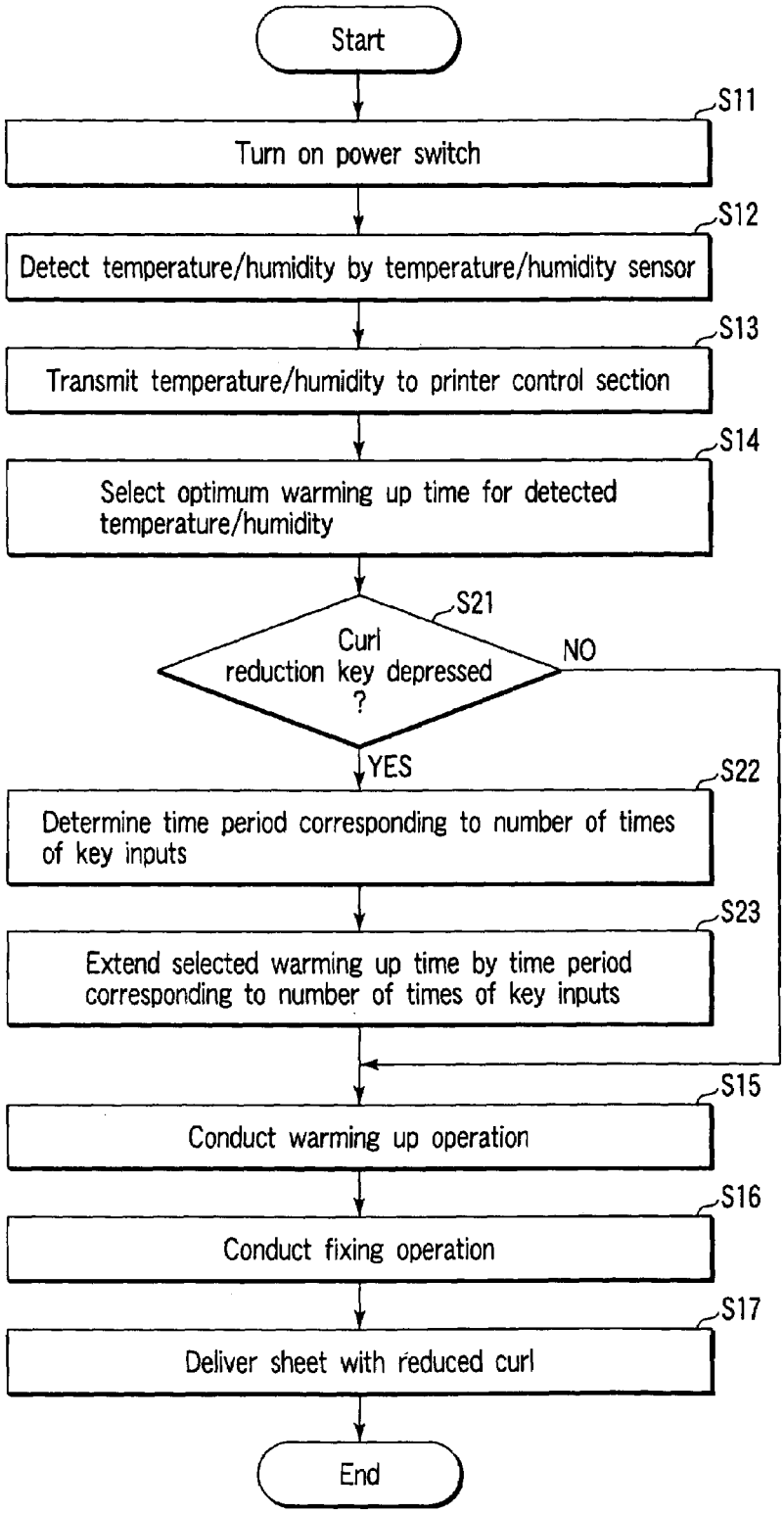
FIG. 10 is a flowchart explaining the operation of the modified example.

FIG. 10 is a flow chart showing the operation obtained by modifying the above described warming up operation.

Since Steps S11 through S17 of FIG. 10 are identical with Steps S1 through S7 of FIG. 9, they will not be described.

Referring to the flow chart of FIG. 10, the printer control section 41 selects the optimum warming up time that corresponds to the temperature and the humidity detected by the temperature/humidity sensor 49 from the data stored in the memory 42 (Step S14). Then, the printer control section 41 judges if the curl reduction key 34*a* is depressed or not (Step S21) when, the optimum warming up time that corresponds to the temperature and the humidity is detected (Step S14).

If the printer control section 41 judges that the curl reduction key 34*a* is depressed, it determines the extension time of the warming up time as a function of the number of times for which the curl reduction key 34*a* is depressed (Step S22). Note that it is so arranged here that the warming up time is extended for a time period that is determined as a function of the number of times by which the curl reduction key 34*a* is depressed.

As the printer control section 41 judges the extension time of the warming up time, it specifies the warming up time by adding the extension time it determined in Step S22 to the optimum warming up time that corresponds to the temperature and the humidity detected in Step S14 (Step S23). As the printer control section 41 determines the final warming up time, it conducts a warming up operation for the warming up time finalized in Step S23 (Step S15).

If, to the contrary, the printer control section 41 judges in Step S21 that the curl reduction key 34*a* is not depressed it proceeds to Step S15, where it conducts a warming up operation for the warming up time that corresponds to the temperature and the humidity detected by the temperature/humidity sensor 49 (Step S15).

As described above, with the modified operation, the optimum warming up time that corresponds to the temperature and the humidity of the operation environment detected by the temperature/humidity sensor is selected and, additionally if a command for reducing the curl of the sheet of paper is input by the user, the optimum warming up time is extended by the time specified by the user for the purpose of reducing the curl.

As a result, it is now possible to conduct a warming up operation for the optimum warming up time selected to reliably suppress the curl quantity of the sheet of paper to a level below a predetermined value and extend the warming up time in order to further reduce the curl quantity if the user desires to do so.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method for fixing developing agent to an image forming medium, the method comprising:

holding in contact a press roller with a heat roller under pressure and heating by heat coming from the heat roller;

detecting the humidity of ambient air;

storing, in a memory, a warming up time for warming up the heat roller and the press roller, the warming up time being stored corresponding to the humidity of ambient air such that the higher the humidity of ambient air, the longer the warming up time becomes; and defining the warming up time corresponding to the humidity detected by the humidity sensor based on the data stored in the memory.

2. The method according to claim 1, further comprising:

receiving an operation instruction provided by operation of an operation key, for reducing the curl quantity of the image forming medium;

wherein the warming up time is extended as defined based on the humidity detected in response to the operation instruction issued by way of the operation key to reduce the curl quantity.

3. The method according to claim 2, wherein the warming up time is extended as defined based on the humidity detected by a predetermined time period each time the operation key is operated.

4. A method for fixing developing agent to an image forming medium, the method comprising:

holding in contact a press roller with a heat roller under pressure and heating by heat coming from the heat roller;

detecting the temperature of ambient air;

receiving an instruction based on actuation of an operation key, for reducing the curl quantity of the image forming medium;

storing, in a memory, data on a warming up time to be observed for a warming up operation of the heat roller and the press roller in order to correspond to the temperature of ambient air; and defining the warming up time corresponding to the temperature based on the data stored in the memory, and conducting a warming up operation of the heat roller and the press roller and extending the warming up time as determined based on the temperature detected in response to the instruction issued by way of the operation key to reduce the curl quantity.

5. The method according to claim 4, wherein the warming up time is extended as determined based on the temperature detected by a predetermined time period each time the operation key is actuated.

6. A method for fixing developing agent to an image forming medium, the method comprising:

holding in contact a press roller with a heat roller under pressure and heating by heat coming from the heat roller;

detecting the temperature of ambient air;

detecting the humidity of ambient air;

storing, in a memory, a warming up time for warming up the heat roller and the press roller, the warming up time being stored corresponding to the humidity of ambient air such that the higher the humidity of the ambient air, the longer the warming up time becomes; and defining the warming up time corresponding to the temperature detected and the humidity detected.

7. The method according to claim 6, further comprising:

receiving an operation instruction provided by operation of an operation key, for reducing the curl quantity of the image forming medium;

wherein the warming up time is extended as defined based on the temperature detected and the humidity detected in response to a command issued by way of actuation of the operation key to reduce the curl quantity.

8. The method according to claim 7, wherein the warming up time is extended as determined based on the temperature detected and the humidity detected by a predetermined time period each time the operation key is actuated.

9. A fixing apparatus for fixing developing agent to an image forming medium, the apparatus comprising:

a first roller which contains a heater;

a second roller which holds in contact with the first roller;

a humidity sensor which detects the humidity of air;

a memory which stores a warming up time for warming up started by switching the heater on, the warming up time being stored corresponding to the humidity of air such that the higher the humidity of air, the longer the warming up time becomes; and a control section which defines the warming up time corresponding to the humidity detected by the humidity sensor based on the data stored in the memory.

10. The apparatus according to claim 9, wherein the first roller is rotated during the warming up.

11. The apparatus according to claim 10, wherein the second roller is rotated during the warming up.

12. The apparatus according to claim 9, wherein the heater heats the first roller by induction heating.

13. The apparatus according to claim 9, wherein the first roller and the second roller form a pair of rollers.

14. A fixing apparatus for fixing developing agent to an image forming medium, the apparatus comprising:

a first roller which contains a heater;

a second roller which holds in contact with the first roller;

a temperature sensor which detects the temperature of air;

a humidity sensor which detects the humidity of air;

a memory which stores a warming up time for warming up started by switching the heater on, the warming up time being stored corresponding to the humidity of air such that the higher the humidity of air, the longer the warming up time becomes; and a control section which defines the warming up time corresponding to the temperature detected by the temperature sensor and the humidity detected by the humidity sensor.

15. The apparatus according to claim 14, wherein the first roller is rotated during the warming up.

16. The apparatus according to claim 15, wherein the second roller is rotated during the warming up.

17. The apparatus according to claim 14, wherein the heater heats the first roller by induction heating.

18. The apparatus according to claim 14, wherein the first roller and the second roller form a pair of rollers.

* * * * *